US006932565B2

(12) United States Patent
Garrett et al.

(10) Patent No.: US 6,932,565 B2
(45) Date of Patent: Aug. 23, 2005

(54) TURBINE

(75) Inventors: Steve E. Garrett, Huddersfield (GB); Nick K. Sharp, Wakefield (GB)

(73) Assignee: Holset Engineering Company, Limited (GB)

( * ) Notice: Subject to any disclaimer, the term of this patent is extended or adjusted under 35 U.S.C. 154(b) by 0 days.

(21) Appl. No.: 10/461,845

(22) Filed: Jun. 13, 2003

(65) Prior Publication Data

US 2004/0101402 A1 May 27, 2004

(30) Foreign Application Priority Data

Jun. 17, 2002 (GB) ..... 0213910

(51) Int. Cl.[7] ..... F01D 17/16; F01D 25/04; F01D 9/02

(52) U.S. Cl. ..... 415/119; 415/158; 415/165; 415/186; 415/208.3; 415/160

(58) Field of Search ..... 415/119, 151, 415/157–159, 160, 163–165, 183, 185–186, 191, 208.1, 208.2, 208.3, 211.1, 914

(56) References Cited

U.S. PATENT DOCUMENTS 4,292,807 A * 10/1981 Rannenberg ..... 415/158
4,318,669 A * 3/1982 Wennerstrom ..... 415/119
4,741,666 A * 5/1988 Shimizu et al. ..... 415/158
4,770,603 A * 9/1988 Engels et al. ..... 415/147
5,529,457 A * 6/1996 Terasaki et al. ..... 415/208.3
5,868,552 A * 2/1999 McKean et al. ..... 415/158
6,007,297 A * 12/1999 Buchelt ..... 415/161

FOREIGN PATENT DOCUMENTS

| | | | |
|---|---|---|---|
| EP | 0375296 | 6/1990 | |
| GB | 2 326 198 | 12/1998 | |
| WO | WO 02/06636 | 1/2002 | |
| WO | WO 200206636 A1 * | 1/2002 | ..... F01D/17/14 |

* cited by examiner

*Primary Examiner*—Edward K. Look
*Assistant Examiner*—Richard A. Edgar
(74) *Attorney, Agent, or Firm*—Krieg DeVault LLP.

(57) ABSTRACT

A turbine comprises a turbine wheel having radial blades and supported in a housing for rotation about an axis. An annular inlet passageway extends radially inwards towards the turbine wheel, the inlet passageway being defined between first and second facing annular walls. An annular array of vanes extend across the inlet passageway. Each vane has a trailing edge extending adjacent the turbine wheel blades, wherein the trailing edge of each vane deviates from a straight line over at least a portion of its length defined between its ends.

20 Claims, 5 Drawing Sheets

TURBINE

FIELD OF THE INVENTION

The present invention relates to a turbine, and in particular to a turbine of a type suitable for use in a turbocharger for an internal combustion engine.

BACKGROUND OF THE INVENTION

In known turbochargers, the turbine stage comprises a turbine chamber within which a turbine wheel is mounted, an annular inlet passageway arranged around the turbine chamber, an inlet arranged around the inlet passageway, and an outlet passageway extending from the turbine chamber. The passageways and chambers communicate such that pressurised exhaust gas admitted to the inlet chamber flows through the inlet passageway to the outlet passageway via the turbine chamber. A turbine wheel with radially extending blades is mounted in the turbine chamber and is rotated by the gas.

It is also well known to trim turbine performance by providing vanes, referred to as nozzle vanes, in the inlet passageway so as to deflect gas flowing through the inlet passageway towards the direction of rotation of the turbine wheel.

Turbines may be of a fixed or variable geometry type. Variable geometry turbines differ from fixed geometry turbines in that the size of the inlet passageway can be varied to optimise gas flow velocities over a range of mass flow rates so that the power output of the turbine can be varied to suit varying engine demands. In the most common type of variable geometry turbine each vane is pivotable about its own axis extending across the inlet passageway (typically aligned with a point approximately halfway along the length of the vane) and a vane actuating mechanism is provided which is linked to each of the vanes and is displaceable in a manner which causes each of the vanes to pivot in unison so that the trailing edge of each vane (i.e. that edge closest the turbine wheel) moves towards or away from an adjacent vane to vary the cross-sectional area available for the incoming gas as well as the angle of approach of the gas to the turbine wheel. Such arrangements are generally referred to as swing vane variable geometry turbines.

In another common type of variable geometry turbine, one wall of the inlet passageway is defined by a moveable wall member, generally referred to as a nozzle ring, the position of which relative to a facing wall of the inlet passageway is adjustable to control the width of the inlet passageway. For instance, as the volume of gas flowing through the turbine decreases the inlet passageway width may also be decreased to maintain gas velocity and optimise turbine output. In some cases the nozzle vanes are fixed in position but extend through slots in a moveable nozzle ring and in others the vanes extend from a moveable nozzle ring into slots provided on the facing wall of the inlet passageway.

In variable geometry turbines with a movable nozzle ring, it is known to provide for "over-opening" of the nozzle ring by withdrawing it beyond the nominal full width of the inlet passageway to retract the vanes at least partially from the inlet passageway and thereby increase the maximum inlet passageway flow area and gas flow rate. In a modification of this system, it is also known to provide a cut-out at the end of the nozzle vanes remote from the nozzle ring. This reduces the length of the trailing edge of the nozzle ring and the height of the nozzle vane over a portion of its width (the height of the vane being the distance it extends from the nozzle ring). There is thus a region at the end of each vane which has a reduced width and which is brought into the inlet passageway as the nozzle ring is over-opened to increase the area of the inlet passageway.

Whatever the form of the turbine, the nozzle vanes are stationary in the sense that they do not rotate with the turbine wheel. This leads to a well known problem caused by the interaction of the rotating wheel blades with a stationary pressure field resulting from the nozzle ring. That is, the periodic nature of this interaction can, at certain rotational speeds, correspond to the resonant frequency of the blades in one or more of their modes of vibration and set up oscillations in the blades.

It is an object of the present invention to obviate or mitigate the above problem.

SUMMARY OF THE INVENTION

According to the present invention there is provided a turbine comprising a turbine wheel having radial blades and supported in a housing for rotation about an axis, an annular inlet passageway extending radially inwards towards the turbine wheel, the inlet passageway being defined between first and second facing annular walls, an annular array of vanes extending across the inlet passageway, each vane having a trailing edge extending adjacent the turbine wheel blades, wherein the trailing edge of each vane deviates from a straight line over at least a portion of its length defined between its ends.

The deviation, which may be provided in the form of a discontinuity in the trailing edge or a curvature in the trailing edge, disturbs the pressure fields generated by the vanes and in particular reduces the vibrations which can affect the turbine blades.

Preferred features of the present invention will be appreciated from the following description.

BRIEF DESCRIPTION OF THE DRAWINGS

Specific embodiments of the present invention will now be described, by way of example only, with reference to the accompanying drawings, in which.

DETAILED DESCRIPTION OF THE PREFERRED EMBODIMENTS

Figure 1A:
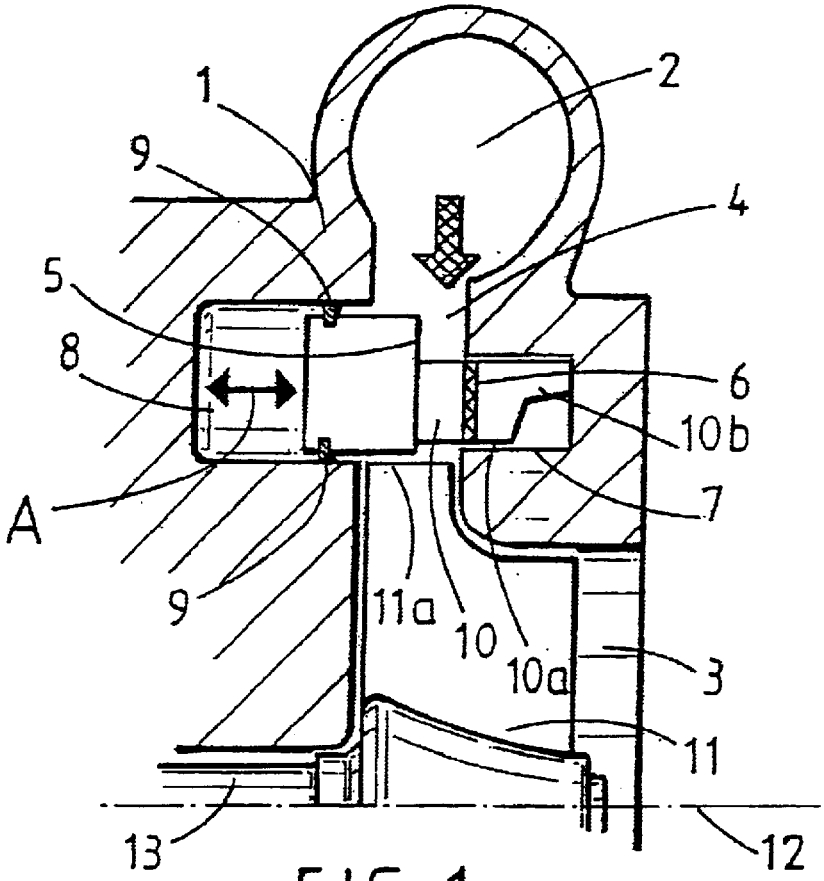
FIG.1a (PRIOR ART)
FIGS. 1*a*, 1*b* and 1*c* are schematic cross-sectional illustrations of part of a known variable geometry turbine.

Referring to FIG. 1, this is a schematic section through part of a known variable geometry turbine which comprises a turbine housing 1 defining a volute or inlet chamber 2 to which gas from an internal combustion engine (not shown) is delivered. The gas flows from the inlet chamber 2 to an axial outlet passageway 3 via an annular inlet passageway 4 defined on one side by the radial face of a nozzle ring 5 and on the other side by an annular shroud plate 6 which covers the opening of an annular recess 7 defined in the opposing wall of the housing 1. The nozzle ring 5 is slidably mounted within an annular cavity 8 provided in the turbine housing 1, and is sealed with respect thereto by sealing rings 9. The nozzle ring 5 supports a circumferential array of nozzle vanes 10 which extend from the face of the nozzle ring 5 across the inlet passageway 4. Each vane 10 is cut away at its end remote from the nozzle ring 5 defining a trailing edge 10*a* and a reduced width portion 10*b*. Although not visible in the figures, in section the vane will typically have an airfoil profile tapering towards the trailing edge 10*a*.

In use, gas flowing from the inlet chamber 2 to the outlet passageway 3 passes over a turbine wheel 11 which rotates about an axis 12 and thereby applies torque to a turbocharger shaft 13 which drives a compressor wheel (not shown). The speed of the turbine wheel 11 is dependent upon the velocity of the gas passing through the annular inlet passageway 4. The vanes 10 are angled to begin turning the gas in the direction of rotation of the turbine wheel. For a fixed rate of flow of gas, the gas velocity is a function of the width of the inlet passageway 4, which can be adjusted by controlling the axial position of the nozzle ring 5 (i.e. by moving it back and forth as indicated by the arrow A). Movement of the nozzle ring 5 may be controlled by any suitable actuation means. For instance, the nozzle ring 5 may be mounted on axially extending pins (not shown) the position of which is controlled by a stirrup member (not shown) linked to a pneumatically operated actuator (not shown). Since the actuator system may take a variety of conventional forms no particular actuator mechanism is illustrated or described in detail.

In FIG. 1*a* the nozzle ring is shown in a closed position at which the width of the inlet passageway 4 is reduced to a minimum. In this position it will be seen that the ends of the nozzle vanes 10 abut the housing 1 within the recess 7, to reduce width portion 10*b* of each vane being entirely received within the recess 7.

Figure 1B:
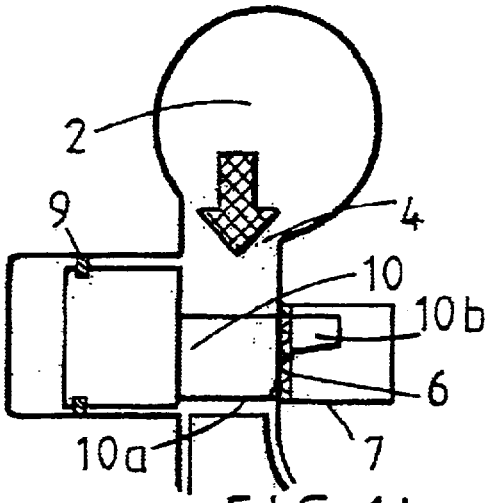
FIG.1b PRIOR Art
Figure 1C:
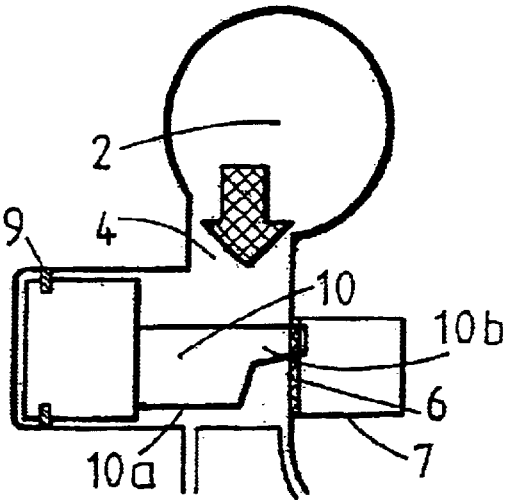
FIG.1c PRIOR Art
Figure 2A:
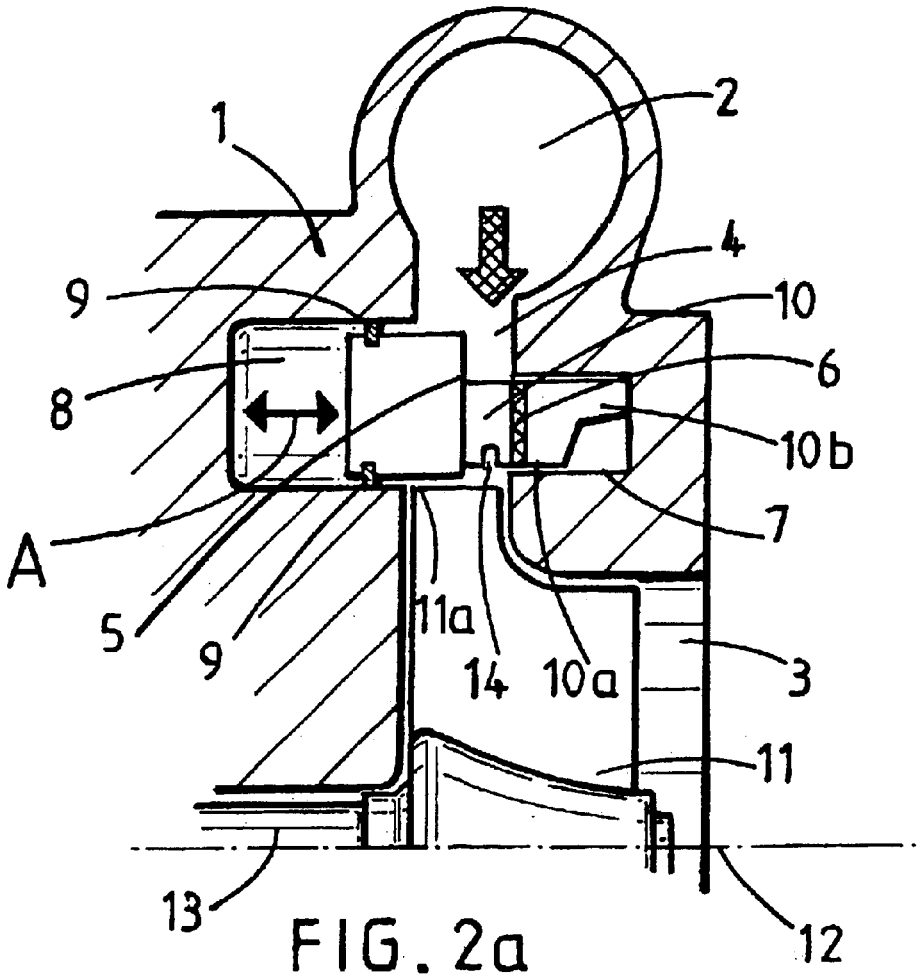
FIGS. 2*a*, 2*b* and 2*c* illustrate modification of the turbine of FIGS. 1*a* to 1*c* in accordance with one embodiment of the present invention.

FIGS. 1*b* and 1*c* show the nozzle ring in fully open and "over open" positions respectively. In the position illustrated in FIG. 1*b* it will be seen that the nozzle ring 5 is withdrawn part way into the cavity 8 so that the face of the nozzle ring 5 is flush with the wall of the housing and the inlet passageway 4 is at its maximum width. To maximise efficiency the length of the trailing edge 10*a* of each vane is sufficient to extend across the inlet passageway 4 when the inlet passageway is fully open as illustrated in FIG. 2*a*. Hence, in this position only the reduced width portion 10*b* of each vane is received within the recess 7.

The swallowing capacity of this particular design of variable geometry turbine can however be increased by further withdrawing the nozzle ring 5 into the cavity 8 so that the reduced width portion 10*b* of each vane is at least partially retracted from the recess 7 to lie within the inlet passageway 4. This reduces the total vane area obstructing gas flow through the inlet passageway 4 allowing increased gas flow. The maximum flow position is that illustrated in FIG. 1*c*.

As mentioned in the introduction to this specification, a known problem encountered in vaned turbocharger designs is that pressure waves generated as tips of the turbine wheel blades 11 sweep past the trailing edge of the vanes 10 they interact with a stationary pressure field generated by the vanes 10 which can induce resonant vibrations in the blades 11 leading to adverse stress.

Figure 2B:
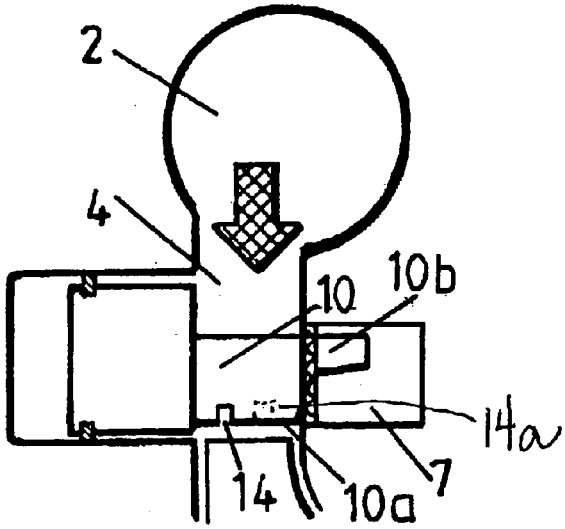
Figure 2C:
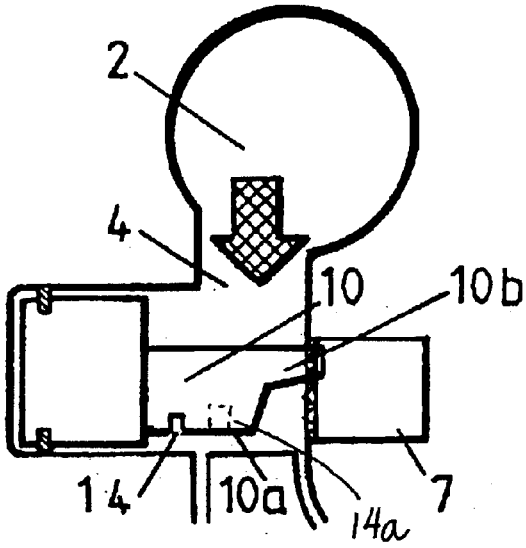
Figure 2D:
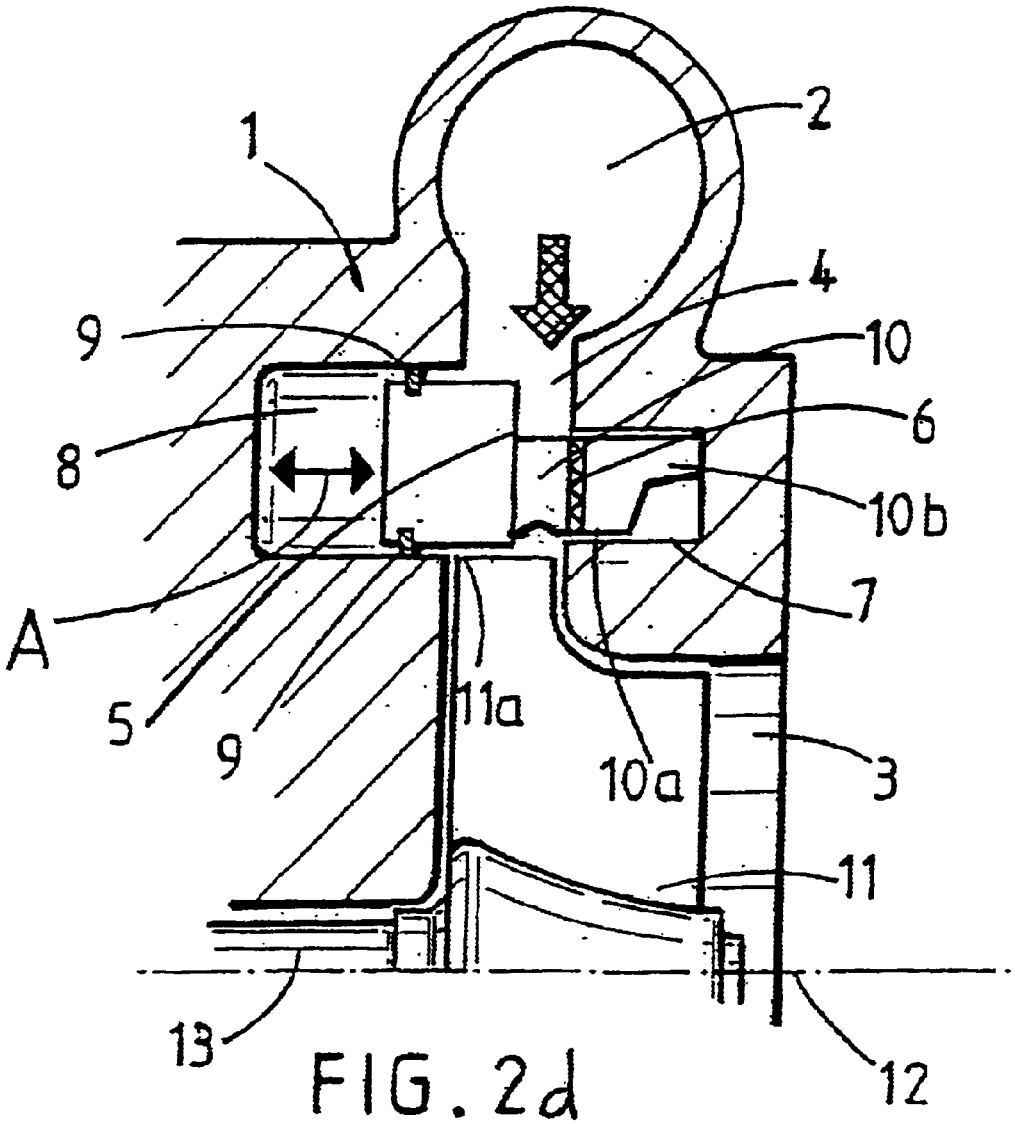

FIGS. 2*a* to 2*c* correspond to FIGS. 1*a* to 1*c* but illustrate a modification of the blade profile in accordance with the present invention. Specifically, a discontinuity is provided in the otherwise straight profile of the trailing edge 10*a* of each vane in the form of a notch 14 located intermediate the ends of the trailing edge 10*a*. The notch 14 disturbs and broadens out the pressure field so that the turbine blades experience a less sharp pressure fluctuation as they pass through the wake and thus the excitation of the blades is reduced. This effectively reduces the strain impact on the turbine blades. Since any given mode of vibration can be encountered over a range of inlet passageway widths (since the excitation is dependent on several parameters such as mass flow rate, temperature and pressure of the gas in addition to the passage width) the notch 14 is positioned to provide influence over as greater range of running conditions as possible. Hence, it can be seen from seen from FIGS. 2*a* and 2*b* that the notch is positioned so as to be located in the inlet passageway 4 between the minimum and maximum inlet passageway widths. In the over open position illustrated in FIG. 2*c* the notch is withdrawn into the cavity 8 within the housing 1 but at this stage the cutaway portion 10*b* of the each vane is exposed in the inlet passageway 4 which also has some effect on disturbing the pressure field and reducing strain on the turbine wheel blades 11.

Figure 3:
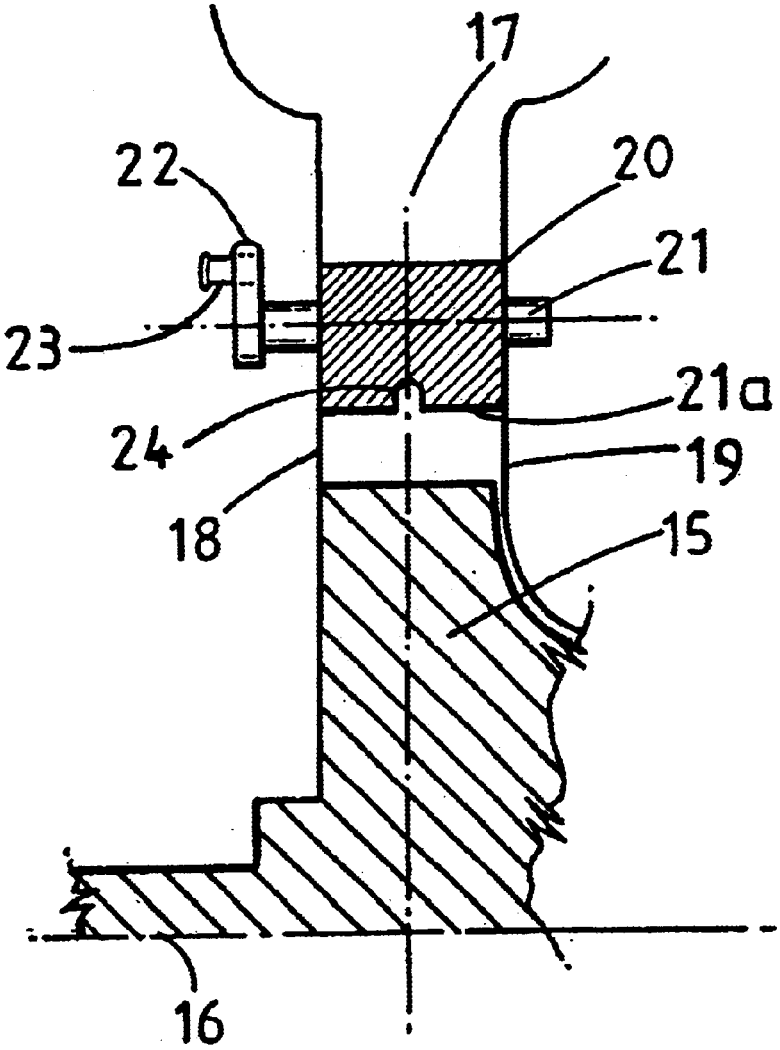
FIG. 3 is a schematic cross-section through part of a second known variable geometry turbine construction but modified in accordance with an embodiment of the present invention.

Referring now to FIG. 3, this shows a similar modification made to an otherwise conventional swing vane turbine comprising a turbine wheel 15 rotatable about an axis 16 within a housing defining an annular inlet passageway 17 between housing walls 18 and 19. As with the embodiment described above, exhaust gases flow into the inlet passageway 17 in a radially inwards direction to drive the turbine wheel. Mounted within the inlet passageway 17 is an annular array of vanes 20 each of which has a respective integral axle 21 that projects through the inlet walls 18 and 19. A crank 22 is provided at one end of the axle 20 which in use is coupled to an actuator (not shown) via a pin 23 to provide controlled rotation of the vanes 20 about the respective axles 21. With this type of variable geometry turbine the area of the inlet passageway 17 is varied by pivoting each vane 21 about its own axle 20 to bring the trailing edge 21*a* of each vane closer to its neighbor thus narrowing the flow passage 17. In accordance with the present invention a discontinuity is provided in the trailing edge 21*a* of each vane intermediate its ends to disturb the pressure field generated as the turbine wheel 15 rotates and thereby reduce vibration and damage to the turbine blades. As with the embodiment of the invention described above, the discontinuity in this embodiment is provided by way of a notch 24 formed in the trailing edge 21*a*.

Figure 4:
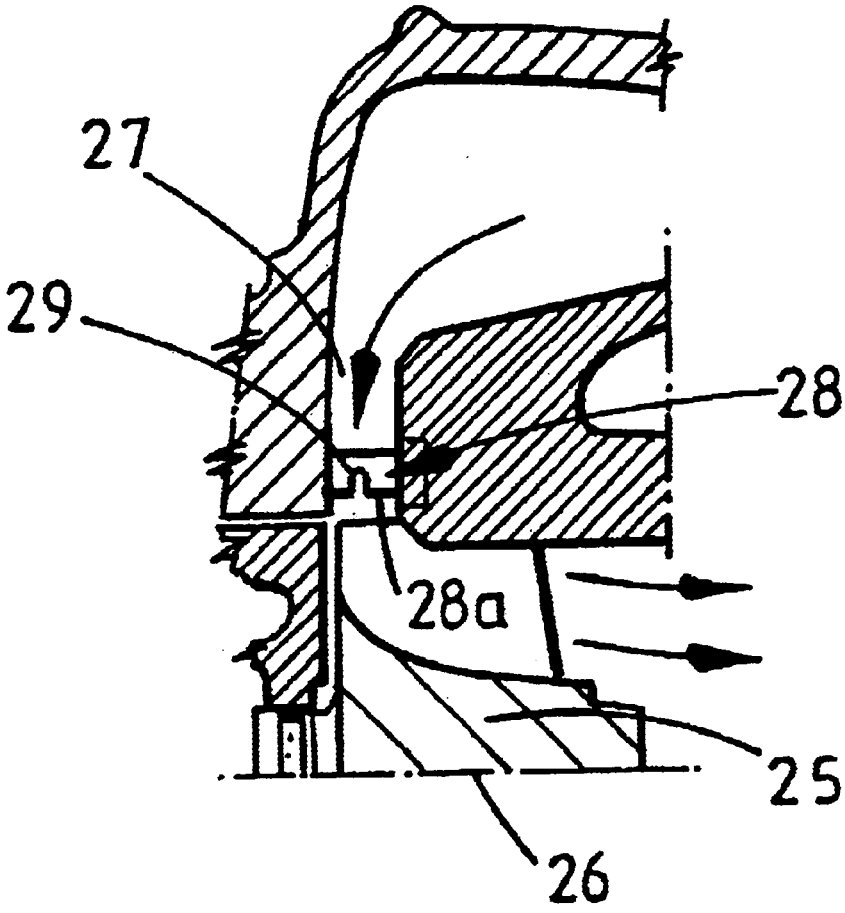
FIG. 4 is a schematic cross-section through part of a fixed geometry turbine modified in accordance with an embodiment of the present invention.

FIG. 4 illustrates application of the invention to a typical fixed geometry turbocharger provided with inlet vanes. Once again, the turbine comprises a turbine wheel 25 rotatable about an axis 26 within a housing defining an inlet passageway 27. Fixed vanes 28 extend across the inlet passageway 27 which in accordance with the present invention are provided with a notch 29 in their trailing edges 28*a*.

In each of the above embodiments of the invention the discontinuity provided to disturb the pressure fields takes the form of a notch provided in an otherwise continuous trailing edge. It is anticipated that the precise positioning, profile and size of the notch (i.e. its width and depth) can have a significant effect on the disruption of the wake and that the skilled person will be able to optimise these features of the notch to suit any particular application. Thus, the notch position, shape and size may vary significantly from that illustrated. Similarly, it may be advantageous to provide more than one discontinuity (e.g. more than one notch—possibly of different sizes/shapes in the trailing edge) in certain applications as shown by the dashed lines 14*a* in FIGS. 2*b* and 2*c*.

The same effect may also be achieved by profiling the trailing edge of each vane so as to deviate from a straight line for at least part of its length in ways other than by forming a notch in the edge. For instance, the trailing edge could be curved either in a circumferential direction relative to rotation of the turbine wheel (effectively by varying the camber of each vane along its length), or in a radial direction, or a combination of both. Such curvature could be provided along the whole length of the trailing edge of each vane or along only a portion or portions of its length. Moreover, such curved edges could be combined with other discontinuities, such as notches as described above.

It will be appreciated that the invention can be applied to any turbine incorporating an array of vanes adjacent the area swept out by the turbine wheel blades and is not limited to the particular constructions and geometries described above. Other possible modifications of the invention will be readily apparent to the appropriately skilled person.

Having thus described the invention, what is claimed as novel and desired to be secured by Letters Patent of the United States is:

1. A turbine comprising a turbine wheel having radial blades and supported in a housing for rotation about an axis, an annular inlet passageway extending radially inwards towards the turbine wheel, the inlet passageway being defined between first and second facing annular walls, an annular array of vanes extending across the inlet passageway, each vane having a trailing edge extending adjacent the turbine wheel blades, wherein the trailing edge of each vane is provided with a discontinuity intermediate its ends, and wherein portions of the trailing edge of each vane on both sides of said discontinuity at least substantially lie on a straight line.

2. A turbine according to claim 1, wherein said line is substantially parallel to lines defined by tips of the turbine wheel blades.

3. The turbine according to claim 1 wherein the trailing edge of each vane is curved along at least a portion of its length at least in one of a circumferential and radial direction relative to the axis of rotation of the turbine wheel.

4. A turbine according to claim 1, wherein the geometry of the inlet passageway is variable.

5. A turbine according to claim 4, wherein the first wall is defined by a moveable wall member which is moveable relative to the facing wall to vary the width of the inlet passageway.

6. A turbine according to claim 5, wherein the vanes are supported by the moveable wall member and said facing wall is provided with a means for receiving ends of the vanes.

7. A turbine according to claim 5, wherein the moveable wall member is slotted to receive said vanes which extend from the facing wall.

8. A turbine according to claim 4 where each vane is rotatably mounted about a respective axes extending across the inlet passageway, the vanes being pivotable about said axes within the inlet passageway.

9. A turbine comprising a turbine wheel having radial blades and supported in a housing for rotation about an axis, an annular inlet passageway extending radially inwards towards the turbine wheel, the inlet passageway being defined between first and second facing annular walls, an annular array of vanes extending across the inlet passageway, each vane having a trailing edge extending adjacent the turbine wheel blades, wherein the trailing edge of each vane includes a plurality of discontinuities located intermediate its ends.

10. A turbine according to claim 9, wherein each discontinuity is a notch defined in the trailing edge.

11. A turbine according to claim 9, wherein the geometry of the inlet passageway is variable.

12. A turbine according to claim 11, wherein the first wall is defined by a moveable wall member which is moveable relative to the facing wall to vary the width of the inlet passageway.

13. A turbine according to claim 12, wherein the vanes are supported by the moveable wall member and said facing wall is provided with a means for receiving ends of the vanes.

14. A turbine according to claim 12, wherein the moveable wall member is slotted to receive said vanes which extend from the facing wall.

15. A turbine comprising a turbine wheel having radial blades and supported in a housing for rotation about an axis, an annular inlet passageway extending radially inwards towards the turbine wheel, the inlet passageway being defined between first and second facing annular walls, an annular array of vanes extending across the inlet passageway, each vane having a trailing edge extending adjacent the turbine wheel blades, the trailing edge of each vane includes at least one notch located intermediate its ends.

16. A turbine according to claim 15, wherein portions of the trailing edge of each vane on both sides of said at least one notch substantially lie on a straight line.

17. A turbine according to claim 16, wherein said line is substantially parallel to lines defined by tips of the turbine wheel blades.

18. A turbine according to claim 15, wherein the geometry of the inlet passageway is variable; and wherein the first wall is defined by a moveable wall member which is moveable relative to the facing wall to vary the width of the inlet passageway.

19. A turbine according to claim 18, wherein the vanes are supported by the moveable wall member and said facing wall is provided with a means for receiving ends of the vanes.

20. A turbine according to claim 18, wherein the moveable wall member is slotted to receive said vanes which extend from the facing wall.

* * * * *